US005150721A

United States Patent [19]

Lee et al.

[11] Patent Number: 5,150,721

[45] Date of Patent: Sep. 29, 1992

[54] TOBACCO SMOKE FILTER MATERIAL AND PROCESS FOR PRODUCTION THEREOF

[76] Inventors: Benedict M. Lee, 1036 Hanover Ct.; James E. Harris, 2305 Norwich Pl., both of Kingsport, Tenn. 37660

[21] Appl. No.: 596,654

[22] Filed: Oct. 10, 1990

Related U.S. Application Data

[63] Continuation-in-part of Ser. No. 486,322, Feb. 28, 1990.

[51] Int. Cl.[5] ..... A24D 3/02

[52] U.S. Cl. ..... 131/331; 131/340; 131/343; 131/345; 536/67; 536/70

[58] Field of Search ..... 131/331, 340, 347, 349, 131/332, 343, 345; 536/69-71

[56] References Cited

FOREIGN PATENT DOCUMENTS 674968 5/1966 Belgium .

1692895 5/1972 Fed. Rep. of Germany .

2084072 12/1971 France .

2349289 11/1977 France .

1029717 5/1966 United Kingdom .

OTHER PUBLICATIONS

Patent Abstracts of Japan, vol. 11, No. 167, May 28, 1987, and JP-A-61 published Dec. 26, 1986 (Daicel Chemical Industries, Ltd.)

*Primary Examiner*—V. Millin

*Attorney, Agent, or Firm*—Mark A. Montgomery; William P. Heath, Jr.

[57] ABSTRACT

Disclosed is a novel process of preparing tobacco smoke filter material, wherein an acidic compound such as citric acid is dissolved in a cellulose acetate spinning solution prior to spinning the filaments of the filter material.

7 Claims, No Drawings

TOBACCO SMOKE FILTER MATERIAL AND PROCESS FOR PRODUCTION THEREOF

This is a continuation-in-part of U.S. Ser. No. 07/486,322 filed Feb. 28, 1990.

FIELD OF INVENTION

The present invention is directed to a tobacco smoke filter material for increasing filtration efficiency of nicotine and other components from tobacco smoke.

BACKGROUND OF THE INVENTION

It is well known that tobacco smoke contains more than four thousand constituents in the form of liquid, solid, or vapor. Cigarette filters commonly used now are made of cellulose acetate, cotton, rayon, or paper. Among these filter materials, over 90% of the filter cigarettes made in the U.S. and a majority of filter cigarettes made in the world use a single-segment cellulose acetate filter. The performance of these filters in terms of pressure drop generation and smoke filtration efficiencies are somewhat limited because of certain requirements for cigarette filters.

The prior known fibrous filters are capable of removing varying percentages of tar and nicotine from cigarette smoke depending on the amount of fibrous material compacted into them, their length, their circumference, their resistance to draw, the surface characteristics of the fiber, the configuration of the fiber, and other factors. These filters, however, show substantially no independent control of the filtration of nicotine from cigarette smoke, without changing the filtration of tar.

U.S. Pat. No. 3,424,173 mentions organic acids such as citric acid as filter additives to remove a higher percentage of nicotine than tar from cigarette smoke. However, it was also mentioned that the addition of an acid to the filter can cause hydrolytic degradation of the fiber by prolonged contact with the applied acid, thus generating acetic acid which gives the filter an objectionable odor and taste. U.S. Pat. No. 3,424,172 discloses a filter containing citric acid that is partially esterified with an alcohol such as, ethanol, to leave at least one free carboxyl group. The application of additives was done by spraying or passing the fibers through a bath of the coating material. The fibers made by this method improve the filtration of nicotine significantly.

Known methods of applying additives in the filter are to dust the additive on the filter or to spray aqueous solution on the filter material. It was observed that the effectiveness of the additive in selective removal of nicotine depends on the total surface area of the additive in the filter. Usually, the total surface area of the additive in powder form applied by dusting is significantly less than that of the additive applied with an aqueous solution. It was observed that the filters dusted with citric acid powder showed a significantly lower performance in selective filtration of nicotine compared with the filters sprayed with citric acid solution. Even though spraying aqueous solution of citric acid on the tow makes the filters effective in selective filtration of nicotine, this application method presents operational problems such as accumulation of tacky deposits on the plugmaker processing rolls, delivery rolls and garniture and a need for a dryer for removing moisture once the solution is applied. It would be beneficial to enhance the nicotine filtration efficiency of tobacco smoke filters while avoiding the above problems.

SUMMARY OF THE INVENTION

The present invention is directed to a process for the preparation of a tobacco smoke filter material comprising (a) dissolving at least one acidic compound selected from non-toxic, non-volatile organic acids into an acetone spinning solution of cellulose acetate; (b) spinning the solution into filaments; and (c) combining the filaments to make filter tow.

The present invention is also directed to the preparation of acidic compound concentrates that are added to the spinning solution.

The tobacco smoke filter material of the present invention has a greater percent absolute increased nicotine filtration efficiency without changing the tar filtration efficiency and without increasing the acetic acid generation above acceptable levels.

DETAILED DESCRIPTION OF THE INVENTION

We have unexpectedly discovered that by dissolving certain acids into a cellulose acetate spinning solution (dope) prior to spinning the filaments that the resulting filter material has increased nicotine filtration efficiency without significantly changing the tar filtration efficiency. We have surprisingly discovered that the presence of the acid in the filter material does not increase the acetic acid generation above an acceptable level if the acid is dissolved into the cellulose acetate dope prior to spinning.

We have also unexpectedly discovered that concentrates containing a high amount of these acids could be made if a water/acetone mixture is added to the cellulose acetate solutions. After addition of the water/acetone mixture a high amount of these acids can be dissolved in the cellulose acetate solutions. A portion of the concentrate is then incorporated into the regular dope to obtain the desired level of citric acid in the tow. This can be accomplished by injecting the concentrate into the dope supply line prior to spinning. The use of a concentrate saves elaborate dope handling systems for making dilute acid dopes.

The preferred non-toxic, non-volatile organic acids (acidic compounds) that are dissolved into the cellulose acetate dope are selected from the group consisting of aliphatic acids within the formula;

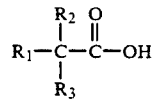

wherein $R_1$, equals H or

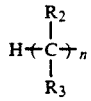

(n=1 to 6), and $R_2$ and $R_3$ independently equal H, OH, $Or_4$,

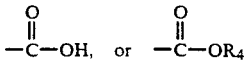

($R_4$=$C_1$ to $C_6$).

The more preferred acidic compounds are selected from the group consisting of citric acid, malic acid, lactic acid, and methoxyacetic acid. The most preferred acidic compound is citric acid due to its effectiveness in removing nicotine from cigarette smoke.

The amount of the acidic compound dissolved in the cellulose acetate dope is preferably at least about 0.1 wt. %. The upper limit of the amount of acidic compound dissolved in the spinning solution depends upon its solubility in the spinning solution Citric acid is readily soluble in water (59.2% at 20° C based on the Merck Index) but is insoluble in acetone. Therefore, the solubility of citric acid in the cellulose acetate dope depends upon the concentration of water in the dope. Generally, the dope contains a small amount of water, typically between about 0.5 and 4 wt. %. At this concentration the theoretical amount of acidic compound, such as citric acid, that can be dissolved in the dope should be small. However, the maximum level of citric acid dissolved in normal cellulose acetate dope was found to be 8 wt. % which is unexpected since the amount of water in the dope is less than 4 wt. %. The preferred amount of acidic compound dissolved in the dope is between about 0.2 and 4 wt. %. The total amount of solids in the acetone solution, including cellulose acetate and additives such as acidic compounds, is generally between about 25 and 35 wt. %.

The method of adding or mixing the acidic compound into the dope can be any conventional method. A preferred method of adding these acidic compounds to the dope to avoid making and handling a whole batch separately is by the addition to the dope of a concentrated dope containing a high amount of acidic compound, such as between about 1 and 32% citric acid. The amount of acidic compound in the concentrated dope will vary depending on the water content in the dope. Thus, the addition of water will permit a higher concentration of acidic compound in the dope. This concentrated dope can then be mixed with the regular spinning dope in a mixing tank or by using an in-line static mixer such as Kenics Static Mixers or Koch Static Mixing Units.

It was found that the addition of water to the dope had to be in the form of a mixture of acetone/water before being added to the cellulose acetate dope. If water is added directly to cellulose acetate dope, a precipitation of cellulose acetate results. It is preferred that the concentrate contain between about 5 and 32 wt. % acidic compound and about 1 and 15 wt. % water; with the concentration of about 20 and 32 wt. % acidic compound and 5 and 10 wt. % water being more preferred.

The method of spinning the cellulose acetate solution can be conducted by any known conventional process such as described in U.S. Pat. No. 3,077,633 the disclosure of which is incorporated herein by reference in its entirety.

It was surprising to discover that the acidic compound such as citric acid present in the dope comes out on the surface of the fiber after spinning. The tobacco smoke filter material produced according to the present invention generally has each individual filament coated with a uniform crystalline coating of fine crystals on the surface of the fibers. The amount of additives such as citric acid on the surface of the fiber will directly affect the effectiveness of the additive in removing certain cigarette smoke components. During the spinning process, a solvent such as acetone used in the dope evaporates in the spinning cabinet and a substantially solidified fiber is formed. The presence of the small amount of acidic compound in the dope might slightly increase the viscosity, therefore, a small amount of acetone can be added to compensate for this slight variance.

The amount of the acidic compound present in the resulting fibers varies proportionally to the amount of acidic compound in the dope. This amount in the resulting fibers is preferably between about 0.4 and 30 wt. % with about 1 and 10 wt. % being more preferred.

A tobacco smoke filter element produced according to the process of the present invention is either in the form of fibers or sheets with fibers being most preferred. The fibers most useful in the present invention are comprised of cellulose acetate.

The tobacco smoke filter material of the present invention can be easily formed into tobacco filters such as cigarette filters and fabricated into a filtered cigarette. This tobacco smoke filter could also be used in combination with other filters such as paper.

Cigarette smoke consists of nonvolatile and volatile components. Nonvolatile components are removed in the fibrous filter primarily by diffusion, interception, and impaction. This mechanical filtration is believed to be nonreversible, that is, a smoke particle which collides with the filter material will not rebound and enter the smoke stream. Volatile smoke components are removed primarily by adsorption, absorption, and chemical reaction. Filtration of volatile smoke components by adsorption and absorption is reversible, that is, the volatile components that condense on the filter surface can reenter the smoke stream. Nicotine in cigarette smoke is a semivolatile component, which means this smoke component is distributed between the volatile and nonvolatile phase. The distribution of the volatile and nonvolatile portions of the nicotine depends on the blend of the tobacco, crop, and smoking conditions. Since the nonvolatile portion of the smoke is removed primarily by mechanical filtration, there is no selective filtration of the nonvolatile portion of the nicotine; however, the volatile portion of the nicotine may be selectively removed.

Typically the use of the tobacco smoke filter material of the present invention increases the nicotine filtration efficiency by about 20% and the nicotine to tar ratios are reduced significantly. In some instances this ratio is reduced more than 20%. Other components can also be significantly reduced in the tobacco smoke by the tobacco smoke filter material of the present invention. These components include for example, water, and other basic components.

The following examples are included to illustrate the present invention but should not be interpreted as a limitation thereon.

EXAMPLE 1

Several gallons of regular acetone spinning solution (dope) containing 25 to 30 percent cellulose acetate and 0.5 to 1.0 percent titanium dioxide were mixed in a mixer, then citric acid granules were added. In this example, the dope was mixed to contain citric acid at 0.5, 1.0, and 1.5 percent by weight. The water level of this dope was between 1.0 and 2.0%. Small amounts of acetone were added to obtain a mixed dope viscosity very similar to the original dope for satisfactory spinning. After the citric acid granules were dissolved completely, the mixed dope was spun into 3.3 denier per filament (D/F), 1,100 total denier, Y cross-section yarn on a regular cellulose acetate solution spinning cabinet. A control yarn was also made, spun from regular dope without citric acid. With each yarn a tow of 39,000 total denier was made by combining several spun yarn ends and crimping the bundled yarn. The final citric acid level in the tow was calculated as approximately 2, 4, and 6 percent by weight. The tows were bloomed and pulled into a plastic straw with a circumference similar to that of commercial cigarette filters. The filter rods were cut to a length of 21 mm, and attached to a commercial tobacco column. These cigarettes assembled with experimental filters were stored for 48 hours in a conditioning chamber which had a temperature of 72° F and a relative humidity of 60%. The conditioned cigarettes were smoke tested for tar, nicotine, and water deliveries by the FTC method, which is the standard method used in the cigarette industry. Table 1 shows the results of the smoke test in comparison with the control.

TABLE 1

| | Samples | | | |
|---|---|---|---|---|
| | Control | No. 1 | No. 2 | No. 3 |
| Citric Acid Content (%) | 0.0 | 2.0 | 4.0 | 6.0 |
| Filter Pressure Drop (mm) | 77 | 74 | 73 | 69 |
| Tar Deliveries (mg) | 16.4 | 16.3 | 16.4 | 16.2 |
| Nicotine Deliveries (mg) | 1.18 | 1.00 | 0.92 | 0.93 |
| Tar Filtr. Eff. (%) | 40.9 | 41.3 | 42.7 | 43.2 |
| Nicotine Filtr. Eff. (%) | 33.1 | 43.0 | 48.9 | 48.5 |
| Nicotine/Tar Ratio | 0.072 | 0.061 | 0.056 | 0.057 |
| % Reduction | — | 15.3 | 22.2 | 20.8 |

As shown in Table 1, nicotine filtration efficiencies of these sample fibers were higher than tar filtration efficiencies. Nicotine filtration efficiencies of normal cellulose acetate filters are about 5 percentage points lower than tar filtration efficiencies. Nicotine to tar ratios of the sample tows were significantly lower than the control and the reduction was over 20% when the citric acid level in the tow was 4.0% or higher. These results revealed the selectivity of nicotine filtration by filters containing citric acid.

EXAMPLE 2

Another sample tow containing 4.0% citric acid was made using the same method described in Example 1. In this example a larger amount of 3.3 D/F, 39,000 total denier, Y cross-section tow was made by combining packages of yarn on an experimental tow crimping line. The tow was processed into filter rods with three different pressure drops representing minimum, maximum, and mid-point tow processing capability points. Plasticizer was applied in this example using standard brush applications. Control filter rods were made with pressure drops similar to the sample rods. The filter rods were cut to a length of 25 mm, and attached to a commercial tobacco column. These cigarettes were stored in a conditioning chamber as in Example 1. The conditioned cigarettes were smoke tested for tar, nicotine, and water deliveries by the FTC method. The results are shown below in Table 2.

TABLE 2

| | Controls | | | Samples | | |
|---|---|---|---|---|---|---|
| Capability Point | Min. | Mid. | Max. | Min. | Mid. | Max. |
| Citric Acid Amt. (%) | 0 | 0 | 0 | 4.0 | 4.0 | 4.0 |
| % Triacetin | 8.6 | 8.0 | 7.3 | 8.8 | 7.0 | 6.9 |
| Filter Press. Drop (mm) | 59 | 69 | 73 | 54 | 69 | 91 |
| Tar Deliveries (mg) | 17.8 | 16.6 | 14.5 | 18.6 | 17.5 | 15.2 |

TABLE 2-continued

| | Controls | | | Samples | | |
|---|---|---|---|---|---|---|
| Capability Point | Min. | Mid. | Max. | Min. | Mid. | Max. |
| Nic. Deliveries (mg) | 1.25 | 1.17 | 1.07 | 1.09 | 1.04 | 0.90 |
| Water Deliveries (mg) | 5.6 | 3.9 | 2.7 | 4.2 | 3.3 | 2.4 |
| Tar Filtr. Eff. (%) | 41.3 | 45.6 | 53.2 | 42.1 | 44.6 | 53.0 |
| Nic. Filtr. Eff. (%) | 34.8 | 39.9 | 49.1 | 49.1 | 51.2 | 58.1 |
| Nicotine/Tar Ratio | .0702 | .0705 | .0738 | .0586 | .0594 | .0596 |
| % Reduction | — | — | — | 16.5 | 15.7 | 19.2 |

As shown in Table 2, nicotine filtration efficiencies of these sample filters were significantly higher than tar filtration efficiencies. Nicotine to tar ratios of the sample filters were between 15 to 19 percent lower than the controls. As the pressure drop of the filters increased, the nicotine to tar ratio also increased slightly, however, the nicotine to tar ratio reduction by the additive did not change significantly. Water deliveries in the smoke were also reduced for the cigarettes with the citric acid filters.

EXAMPLE 3

Another set of sample rods was made with 5 percent citric acid in the tow by using the same method described in Example 2. In this example, filter rods representing three capability points (pressure drop points at three tow weights) were obtained from each sample tow. However, only the mid point rods were tested for tar, nicotine, and water deliveries. The smoke test results are shown in Table 3. The filter length used on these cigarettes was 21 mm.

TABLE 3

| | Control | Sample |
|---|---|---|
| Citric Acid Amount (%) | 0.0 | 5.0 |
| Filter Pressure Drop (mm) | 51 | 46 |
| Tar Deliveries (mg) | 20.6 | 20.8 |
| Nicotine Deliveries (mg) | 1.31 | 1.04 |
| Water Deliveries (mg) | 4.2 | 3.5 |
| Tar Filtr. Eff. (%) | 38.8 | 39.5 |
| Nicotine Filtr. Eff. (%) | 34.5 | 49.3 |
| Nicotine/Tar Ratio | .0636 | .0500 |
| % Reduction | — | 21.4 |

In this example the nicotine to tar ratio reduction with 5 percent citric acid in the filter was 21.4%.

EXAMPLE 4

Sample rods were made with 5 percent citric acid in tow as described in Examples 2 and 3. Other sample rods were also made by spraying 50/50 citric acid/water solution on the control tow during plugmaking by using the brush applicator normally used for plasticizer application. Plasticizer for these rods was applied to the tow with a wick type applicator installed between the delivery roll and the garniture. The filter tow used for this example was 3.3 D/F, 39,000 total denier, Y cross section. Rods were cut to 21 mm length, then attached to commerical tobacco columns. Smoke test results of these sample cigarettes and the control are shown in Table 4.

TABLE 4

| | Control | Sample No. 1 | Sample No. 2 |
|---|---|---|---|
| Citric Acid Amount (%) | 0.0 | 5.0 | 5.0 |
| Application method | — | Sprayed | Dope Mixed |
| Filter Pressure Drop (mm) | 70 | 70 | 70 |
| Tar Deliveries (mg) | 17.3 | 17.4 | 16.9 |

TABLE 4-continued

| | Control | Sample No. 1 | Sample No. 2 |
|---|---|---|---|
| Nicotine Deliveries (mg) | 1.27 | 1.04 | 0.99 |
| Water Deliveries (mg) | 4.0 | 3.0 | 3.3 |
| Tar Filtr. Eff. (%) | 41.7 | 41.4 | 43.8 |
| Nicotine Filtr. Eff. (%) | 42.1 | 52.7 | 55.5 |
| Nicotine/Tar Ratio | .0734 | .0598 | .0586 |
| % Reduction | — | 18.5 | 20.2 |

This example shows that the nicotine to tar reduction achieved by mixing citric acid in the dope before spinning is at least as good as spraying citric acid solution on the tow. The nicotine to tar ratio reduction of the dope-mixed tows was 20.2 percent compared to 18.5 percent for the sprayed tow.

EXAMPLE 5

Another set of sample filter rods were made by spraying additives on to the tow during filter rod manufacture. Instead of citric acid, the additives used were lactic acid, malic acid, and ascorbic acid. The filter rods were cut to a length of 21 mm, and attached to commerical tobacco columns. These cigarettes assembled with experimental filters were smoke tested. The results are shown in Table 5.

TABLE 5

| | Control | Sample No. 1 | Sample No. 2 | Sample No. 3 |
|---|---|---|---|---|
| Additive | None | Lactic Acid | Malic Acid | Ascorbic Acid |
| Amt. Applied (Wt. %) | — | 5.0 | 5.0 | 10.3 |
| Filter Pressure Drop (mm) | 73.4 | 73.7 | 74.2 | 68.0 |
| Tar Deliveries (mg) | 19.0 | 18.7 | 18.6 | 19.8 |
| Nicotine Deliveries (mg) | 1.35 | 1.14 | 1.13 | 1.20 |
| Water Deliveries (mg) | 6.0 | 4.0 | 3.5 | 5.2 |
| Tar Filtration Eff. (%) | 38.7 | 38.3 | 38.4 | 37.0 |
| Nicotine Filtration Eff. (%) | 34.0 | 42.1 | 43.5 | 43.9 |
| Nicotine/Tar Ratio | .0710 | .0610 | .0608 | .0606 |
| % Reduction | — | 14.1 | 14.5 | 14.7 |

As shown in Table 5, these acids also reduced the nicotine to tar ratio significantly. To determine the feasibility of making filter tows containing these additives by mixing the additives in the dope, dope samples were made with these additives added to the dope mixture at 5.0 percent based on the amount of solids in the dope. These acid additives dissolved completely and they remained in the dope without separation or deterioration. These mixed dopes were spun into 2.1 D/F yarn on a regular cellulose acetate solution spinning cabinet without any difficulty. Mixed dopes were also made with DL-alanine and methoxyacetic acid at 5.0 percent based on the amount of solids in the dope. Methoxyacetic acid was compatible with cellulose acetate dope; however, DL-alanine was not.

EXAMPLE 6

The purpose of this example was to determine the surface coverage of citric acid on a film that was cast from an acetone dope containing 25% cellulose acetate and 2.7% citric acid.

An electron spectroscopy for chemical analysis (ESCA) measurement was used to determine the elemental composition of the surface of the film. A film was used instead of a spun yarn because the samples for the ESCA measurement should have a flawless and smooth surface. The results are shown below in Table 6.

TABLE 6

ESCA Analysis of Cellulose Acetate Film

| | Relative Atomic % | | | |
|---|---|---|---|---|
| Chemical Group | CH | C—O | O—C—O | O=C—O |
| Cellulose Acetate Film | 37 | 34 | 10 | 20 |
| Acetate Film Made From Dope (10 wt. % Citric Acid)* | 39 | 36 | 0 | 24 |
| 100% Citric Acid. Anhydrous | 56 | 10 | 0 | 34 |
| Acetate Film Sprayed With Citric Acid Solution (About 10 wt. %)* | 37 | 36 | 3 | 23 |
| Theoretical Values | | | | |
| Cellulose Acetate | 20 | 50 | 10 | 20 |
| Citric Acid | 33 | 17 | 0 | 50 |

*Based on total solids

As shown in Table 6 the acetate film made with 2.7% citric acid mixed in dope, to contain about 10% in the film, had no O—C—O groups on the surface of the film. A O—C—O group is an unique bond present in cellulose acetate fiber. Therefore, absence of O—C—O group is ESCA analysis implies complete coverage of the surface with citric acid.

EXAMPLE 7

The purpose of this example was to determine the amount of acetic acid generated during storage of different filter materials. Sample filter rods were made with acetate filter tows containing citric acid as described in Example 4. Control filters were also made containing no citric acid. The filter rods made from these three different tows were attached to commercial tobacco columns, packaged and then measured for acetic acid level in the filter every two weeks. The results are shown in Table 7. Analysis were made by headspace gas chromatography.

TABLE 7

Amount of Acetic Acid in The Filters Containing Citric Acid (Unit:ppm)

| Age of Cigarette (week) | Control | Citric Acid Sprayed | Citric Acid Mixed in Dope |
|---|---|---|---|
| 0 | 459 | 1279 | 1371 |
| 2 | 237 | 1359 | 790 |
| 4 | 494 | 3524 | 424 |
| 6 | 310 | 2518 | 807 |
| 8 | 303 | 2543 | 1001 |
| 10 | 362 | 2308 | 775 |
| 12 | 446 | 2147 | 898 |
| Average | 373 | 2240 | 867 |

As shown in Table 7 the amount of acetic acid generated from filters with citric acid sprayed on the tow at the plugmaker is 2.6 times higher than that of the rods made from the tow with citric acid applied in the dope.

EXAMPLES 8-12

The following examples illustrate the use of concentrates containing a high amount of acidic compounds in cellulose acetate solutions according to a preferred method of the present invention.

EXAMPLE 8

Another trial was made to increase the amount of citric acid dissolved in dope by mixing 50 percent citric acid (Anhydrous, H2041-05H in 50-lb. bag made by Pfizer Chemical) in water with acetone in the 50 to 50 ratio before adding it to cellulose acetate dope. The final levels of citric acid and other components are described in Table 8.

TABLE 8

| Sample | Water (gr.) | Acetone (gr.) | Cellulose acetate (gr.) | Citric acid (gr.) | Citric acid (%) |
|---|---|---|---|---|---|
| 8 - 1 | 13.0 | 69.8 | 21.2 | 36.0 | 25.7 |
| 8 - 2 | 9.0 | 61.8 | 21.2 | 24.0 | 20.7 |
| 8 - 3 | 9.0 | 65.8 | 21.2 | 24.0 | 20.0 |
| 8 - 4 | 9.0 | 65.8 | 21.2 | 32.0 | 25.0 |

All samples showed complete dissolving of the citric acid in the solution.

EXAMPLE 9

Citric acid concentration dopes were made by adding a 50/50 mixture of water and acetone to cellulose acetate dope, and then adding various amounts of citric acid. The sample solutions tried are shown in Table 9.

TABLE 9

| Sample | Water (gr.) | Acetone (gr.) | Cellulose acetate (gr.) | Citric acid (gr.) | Citric acid (%) |
|---|---|---|---|---|---|
| 9 - 1 | 9.0 | 65.8 | 21.2 | 24.0 | 20.0 |
| 9 - 2 | 9.0 | 65.8 | 21.2 | 32.0 | 25.0 |
| 9 - 3 | 9.0 | 65.8 | 21.2 | 40.0 | 29.4 |
| 9 - 4 | 9.0 | 65.8 | 21.2 | 48.0 | 33.3 |
| 9 - 5 | 9.0 | 65.8 | 21.2 | 44.0 | 31.4 |

Among these solutions, all but the 9-4 sample showed complete dissolving of the citric acid. This test shows that the maximum concentration of citric acid in cellulose acetate dope is 31.4 percent when a certain amount of water/acetone solution is added to the dope.

EXAMPLE 10

Another study on citric acid solubility in acetone dope of cellulose acetate was made by adding various ratios of water and acetone. A few mixtures of water and acetone were made in the ratios of 75/25, 60/40, and 50/50, and then these mixtures were added to acetone dope of cellulose acetate. Citric acid was added to the mix in three levels, then they were mixed on a roller for a few days. Table 10 shows the solutions made for the solubility analysis.

TABLE 10

| Sample | Water (gr.) | Acetone (gr.) | Cellulose acetate (gr.) | Citric acid (gr.) | Citric acid (%) |
|---|---|---|---|---|---|
| 10 - 1 | 11.0 | 82.5 | 26.5 | 55.0 | 31.4 |
| 10 - 2 | 11.0 | 82.5 | 26.5 | 75.0 | 38.5 |
| 10 - 3 | 11.0 | 82.5 | 26.5 | 65.0 | 35.1 |
| 10 - 4 | 13.0 | 80.5 | 26.5 | 55.0 | 31.4 |
| 10 - 5 | 13.0 | 80.5 | 26.5 | 75.0 | 38.5 |
| 10 - 6 | 13.0 | 80.5 | 26.5 | 65.0 | 35.1 |
| 10 - 7 | 16.0 | 77.5 | 26.5 | 55.0 | 31.4 |
| 10 - 8 | 16.0 | 77.5 | 26.5 | 75.0 | 38.5 |
| 10 - 9 | 16.0 | 77.5 | 26.5 | 65.0 | 35.1 |

In this trial, only the solutions containing 31.4% citric acid in the dope dissolved completely. The other solutions containing higher amounts of citric acid showed a jelling in the solution.

EXAMPLE 11

Another trial was made to determine whether a higher amount of acetone improve the solubility of citric acid in dope. The following solutions were made by adding acetone/water 60/40 and 75/25 solution in cellulose acetate dope, and then adding various amounts of citric acid in the mixed dope.

TABLE 11

| Sample | Water (gr.) | Acetone (gr.) | Cellulose acetate (gr.) | Citric acid (gr.) | Citric acid (%) |
|---|---|---|---|---|---|
| 11 - 1 | 9.0 | 84.5 | 26.5 | 65.0 | 35.1 |
| 11 - 2 | 9.0 | 84.5 | 26.5 | 65.0 | 31.4 |
| 11 - 3 | 6.0 | 87.5 | 26.5 | 65.0 | 35.1 |

Citric acid granules added to these solutions did not dissolve, and a jelling was observed.

These experiments showed that citric acid could be dissolved in acetone solution of cellulose acetate up to 31.4 percent with the addition of water. However, the addition of water has to be in water/acetone (eg 50/50) solution before adding it to the cellulose acetate dope. Any other combination of water and acetone created jelling when citric acid granules were added to the dope.

EXAMPLE 12

This example illustrates the use of an acidic compound concentrate in producing the filter material containing the acidic compound. A solution was prepared by mixing 22.85 lbs. of acetate and 22.85 lbs. (metric) of water. This solution was added to a large mixer containing 228.6 lbs. (metric) of regular acetate dope. In this mix 125.7 lbs. (metric) of citric acid anhydrous granules were added to the solution, then it was mixed for 16 hours. This solution contained 31.4% citric acid. The concentrated citric acid dope was injected into the dope supply line of a spinning machine with a couple of metering pumps. This dope was then mixed homogeneously with a series of static in-line mixers before spinning into filter tow fiber. Spinning was done by using a regular spinning machine with the conditions set as the same as spinning the normal spinning dope. The metering pump speed was set to make the final tow contain 2.6% and 4.8% citric acid. The specifications of the tows were 3.0 dpf, 35,000 total denier, and Y cross section with 15 to 25 crimps per inch. The crimped tows containing citric acid was processed into filter rods on a Mollins/Eastman miniature filter rod making machine. The filters were evaluated for smoke filtration efficiencies, and the results are shown below.

TABLE 12

| | Control | Samples No. 1 | Samples No. 2 |
|---|---|---|---|
| Citric Acid Content (%) | 0.0 | 2.6 | 4.8 |
| Filter Pressure Drop (mm) | 78.0 | 76.0 | 73.0 |
| Tar Deliveries (mg) | 16.1 | 16.4 | 16.4 |
| Nicotine Deliveries (mg) | 1.10 | 0.89 | 0.85 |
| Water Deliveries (mg) | 2.7 | 3.4 | 3.5 |
| Tar Filtration Eff. (%) | 42.9 | 42.8 | 44.5 |
| Nicotine Filtration Eff. (%) | 43.1 | 52.8 | 56.5 |
| Nicotine/Tar Ratio | .0683 | .0543 | .0518 |
| % N/T Reduction | — | 20.5 | 24.2 |

TABLE 12-continued

| | Control | Samples No. 1 | Samples No. 2 |
|---|---|---|---|
| Water/Tar Ratio | 0.17 | 0.21 | 0.21 |
| % W/T Increase | — | 24 | 24 |

As shown in this example, significant reductions of nicotine to tar ratios were observed by using filters containing citric acid. Filtration efficiencies of nicotine were increased 9.7 and 13.4 percentage points, respectively, with 2.6 and 4.8 percent citric acid in the filter. Water to tar ratios were increased significantly with citric acid in the filter.

This invention has been described in detail with particular reference to preferred embodiments, however, it is understood that variations and modifications can be made without departing from the reasonable scope of the present invention.

We claim:

1. A process for preparing a tobacco smoke filter material comprising:

(a) dissolving about 5 to 32 wt. % of at least one acidic compound selected from nontoxic, nonvolatile organic acids, into cellulose acetate solution containing between about 1 and 15 wt. % water and about 35 to 75 wt. % acetone;

(b) adding the concentrate of (a) to an acetone spinning solution of cellulose acetate;

(c) spinning said solution into filaments; and (d) combining said filaments to make filter tow.

2. The process according to claim 1 wherein said acidic compound is selected from the group consisting of aliphatic acids within the formula;

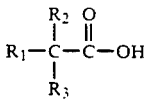

wherein $R_1$, equals H or

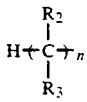

(n=1 to 6), and R2 and R3 independently equal H, OH, $OR_4$,

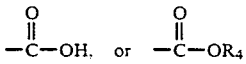

($R_4=C_1$ to $C_6$).

3. The process according to claim 1 wherein said acidic compound is selected from the group consisting of citric acid, malic acid, lactic acid, and methoxyacetic acid and said spinning solution contains a minor amount of water.

4. The process according to claim 1 wherein the concentrated solution of (a) contains between about 5 and 10 weight percent water and between about 20 and 32 wt. % acidic compound dissolved therein.

5. The process according to claim 2 wherein said spinning solution contains between about 0.5 and 4 weight percent water and between about 0.1 and 8 wt. % citric acid dissolved therein.

6. The process according to claim 1 wherein said filter tow contains between about 0.4 and 30 wt. % citric acid.

7. The process according to claim 6 wherein said filter tow contains between about 1 and 10 wt. % citric acid in the form of fine crystals.

* * * * *